US009702575B2

(12) United States Patent
Niedermann et al.

(10) Patent No.: US 9,702,575 B2
(45) Date of Patent: Jul. 11, 2017

(54) APPLIANCE REQUIRING INTAKE AIR DURING OPERATION

(75) Inventors: Dirk Niedermann, Bloomingdale, IL (US); Kelvin Li, Kowloon (HK)

(73) Assignee: Wachsmuth and Krogmann, Inc., Itasca, IL (US)

( * ) Notice: Subject to any disclaimer, the term of this patent is extended or adjusted under 35 U.S.C. 154(b) by 2493 days.

(21) Appl. No.: 12/460,055

(22) Filed: Jul. 13, 2009

(65) Prior Publication Data

US 2011/0009048 A1 Jan. 13, 2011

(51) Int. Cl.
*F24F 7/06* (2006.01)
*F24F 7/007* (2006.01)
*F24F 6/02* (2006.01)

(52) U.S. Cl.
CPC ..... *F24F 6/02* (2013.01); *F24F 2221/12* (2013.01)

(58) Field of Classification Search
USPC ..... 454/338, 364, 365, 354, 355
See application file for complete search history.

(56) References Cited

U.S. PATENT DOCUMENTS 4,109,564 A * 8/1978 Widerby ..... 454/302
7,712,249 B1 * 5/2010 Modlin et al. ..... 43/132.1
8,025,270 B2 * 9/2011 Hou ..... 261/26

* cited by examiner

*Primary Examiner* — Helena Kosanovic
(74) *Attorney, Agent, or Firm* — Wood, Phillips, Katz, Clark & Mortimer

(57) ABSTRACT

A portable appliance with a housing defining a space for operating components. The operating components define an air moving mechanism for causing atmospheric air to be drawn into the housing space to at least one of: a) cool at least one of the operating components; b) be treated by at least one of the operating components; and c) cause movement of a fluid within the housing space. The housing has a first wall with a downwardly facing surface in which an inlet opening is defined through which atmospheric air is drawn into the housing space. The housing further has a spacing wall that underlies the inlet opening and bounds in conjunction with the first wall an intake space through which atmospheric air is guided in a generally horizontal path towards the inlet opening.

21 Claims, 4 Drawing Sheets

APPLIANCE REQUIRING INTAKE AIR DURING OPERATION

BACKGROUND OF THE INVENTION

Field of the Invention

This invention relates to appliances, such as air treatment appliances and, more particularly, to an appliance requiring a continuous intake of atmospheric air during operation thereof.

Background Art

A large number of consumer appliances are designed to continuously intake air during operation thereof. This air may be used for cooling purposes and/or treated by the particular apparatus and thereafter directed to a surrounding space.

An example of the latter appliance is one that purifies air. Air to be treated is drawn into a housing at an intake location, treated by being exposed to filter media and/or ultraviolet light, and exhausted after treatment through an outlet.

Typically, the air intake is below the air outlet. The air is forced in a vertical path through the housing. To minimize the required vertical dimension of the appliance, the intake is made as close as possible to the bottom of the housing.

Limiting housing size is particularly important with portable consumer appliances. Consumers seek designs that are functionally efficient and unobtrusive so that they can be placed at convenient locations around a home.

One highly efficient design for air treatment appliances of the above type locates the intake for air in a bottom, downwardly facing wall on the housing. Central location of this intake opening on the bottom wall causes air to be drawn in potentially around the entire perimeter of the housing, at the bottom thereof. This design permits potentially high volume air handling.

Effective operation of the above design requires that there be adequate clearance between the intake and a support surface for the appliance. Typically, supporting feet will be provided on the bottom wall to support the appliance upon a firm, upwardly facing surface so that there is adequate clearance to permit room air to flow freely to the inlet.

Often, however, users will place the appliance on a carpeted surface. Depending upon the nature of the carpet, the supporting appliance feet may depress into the carpet, thereby reducing the clearance from that for which the appliance is optimally designed. In a worse case, the intake may be substantially or fully blocked, in which event the appliance may be nonfunctional.

While instructions are normally given in operator manuals to avoid such conditions, they nonetheless are commonly created by users. Even though the placement of the appliance may account for inefficient operation, or a total failure to operate, the consumer may blame the appliance manufacturer for these problems. This reaction may have a devastating effect upon sales, particularly in an age when consumer feedback through surveys is actively solicited and such feedback is widely disseminated in hard copy form and electronically over the internet.

Heretofore, manufacturers of this type of appliance have been forced to balance the often competing objectives of providing the most efficient appliance design and making a product that is not likely to be used by consumers in a manner that will impair its operation. Designers of this type of equipment continue to seek alternative designs to address these issues.

SUMMARY OF THE INVENTION

In one form, the invention is directed to a portable appliance with a housing defining a space for operating components. The housing has a top and bottom. The operating components define an air moving mechanism for causing atmospheric air to be drawn into the housing space to at least one of: a) cool at least one of the operating components; b) be treated by at least one of the operating components; and c) cause movement of a fluid within the housing space. The housing has a first wall with a downwardly facing surface in which an inlet opening is defined through which atmospheric air is drawn into the housing space. The housing further has a spacing wall that underlies the inlet opening and bounds in conjunction with the first wall an intake space through which atmospheric air is guided in a generally horizontal path towards the inlet opening.

In one form, the downwardly facing surface is substantially flat and the spacing wall has a substantially flat surface that faces, and is spaced beneath, the downwardly facing surface on the first wall.

In one form, the downwardly facing surface on the first wall and the flat surface on the spacing wall are substantially parallel to each other.

In one form, the spacing wall has a peripheral edge and the intake space is defined substantially fully around the peripheral edge of the spacing wall.

In one form, the spacing wall is aligned to substantially fully block the inlet opening as viewed from the bottom of the housing.

In one form, the housing has a peripheral edge and the intake space is defined at and around at least a portion of the peripheral edge of the housing.

In one form, the first wall has a horizontal center and the inlet opening is located at or adjacent to the horizontal center.

In one form, there is a plurality of spacer elements that reside between the first wall and the spacing wall.

In one form, the inlet opening has a generally circular shape and the spacing wall has a portion that is curved and at least nominally conformed to the circular shape of the inlet opening.

In one form, the operating components produce steam and the air moving mechanism causes air to be drawn into the housing space to force movement of the steam within the housing space.

In one form, the operating components treat air and the air moving mechanism causes air to be drawn into the housing space to be treated by the operating components.

In one form, at least one of the operating components generates heat in operation and the air moving mechanism causes air to be drawn into the housing space to cool the at least one operating component that generates heat.

In one form, the portable appliance further has spacing elements on the downwardly facing surface of the first wall defining bearing surfaces that cooperatively support the portable appliance on an upwardly facing, subjacent support surface.

In one form, the bearing surfaces project further downwardly from the downwardly facing surface on the first wall than the spacing wall.

In one form the spacing wall has an area that is substantially less than the area of the downwardly facing surface on the first wall.

In one form, the intake space is defined through less than 90° around the peripheral edge of the housing.

In one form, the portable appliance further has at least one fastener that extends through the first wall and one of the spacer elements into the spacing wall to maintain the spacing wall in place.

In another form, the invention is directed to a portable appliance with a housing having a top and a bottom and defining a space for operating components. The operating components make up an air moving mechanism for causing atmospheric air to be drawn into the housing space to at least one of: a) cool at least one of the operating components; b) be treated by at least one of the operating components; c) cause movement of a fluid within the housing space. The housing has an inlet opening through which atmospheric air is drawn vertically upwardly into the housing space. The housing further has a spacing wall that underlies the inlet opening to at least partially block the inlet opening, as viewed from the bottom of the housing, and bounds an intake space through which atmospheric air is guided in a generally horizontal path towards the inlet opening.

In one form, the spacing wall has a peripheral edge and the intake space is defined substantially fully around the peripheral edge of the spacing wall.

In one form, the housing has a peripheral edge and the intake space is defined at and around at least a portion of the peripheral edge of the housing.

DETAILED DESCRIPTION OF THE PREFERRED EMBODIMENT

Figure 1:
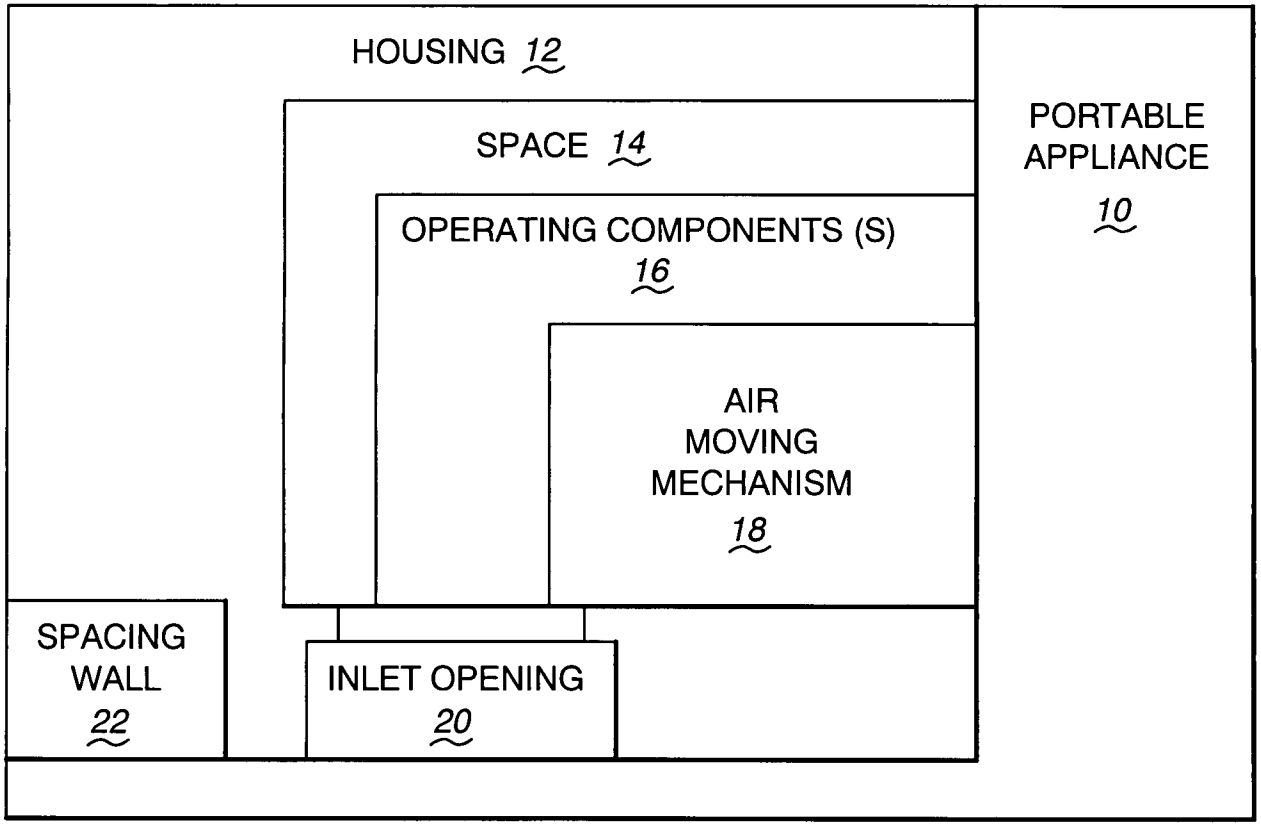
FIG. 1 is a schematic representation of a portable appliance according to the present invention.
Figure 2:
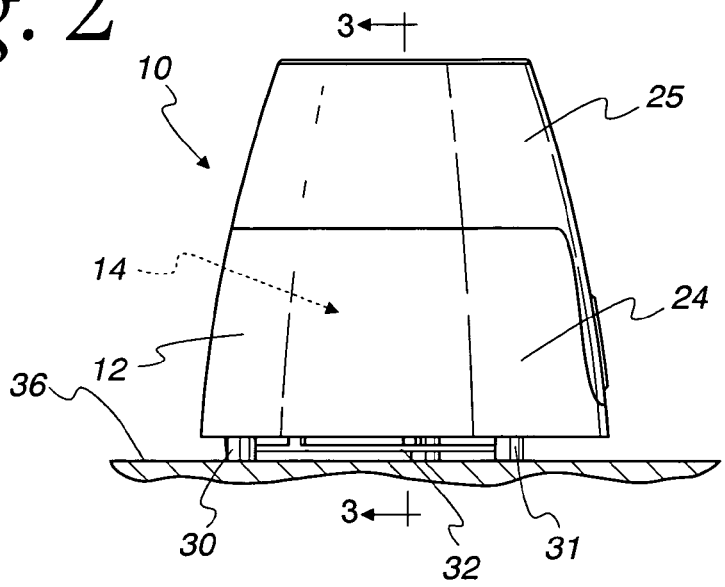
FIG. 2 is a side elevation view of one specific form of portable appliance, as shown in FIG. 1, in the form of a humidifier.
Figure 3:
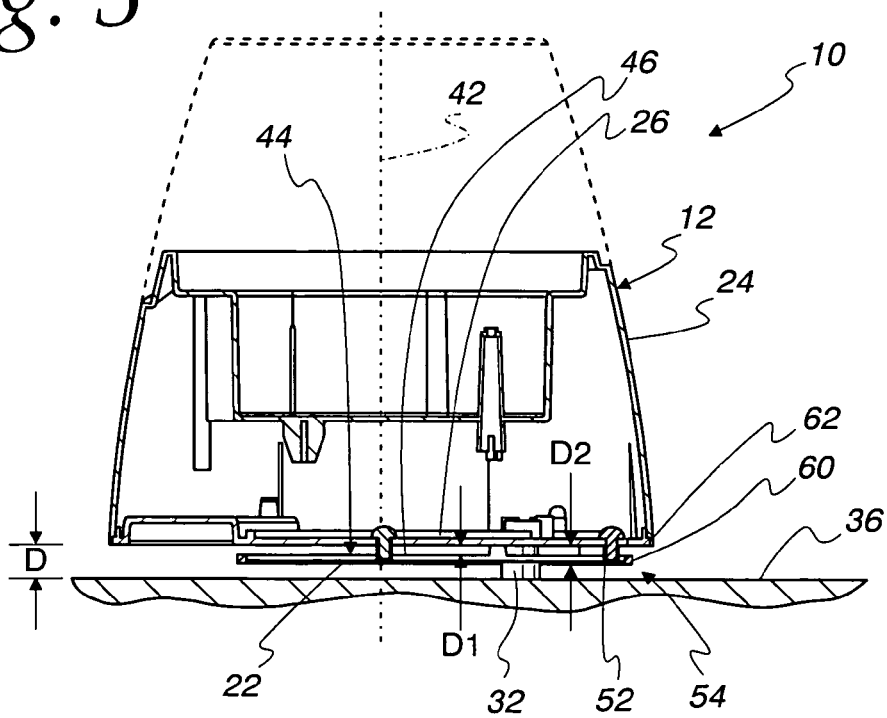
FIG. 3 is a cross-sectional view of the appliance taken along line FIG. 3 of FIG. 2.
Figure 4:
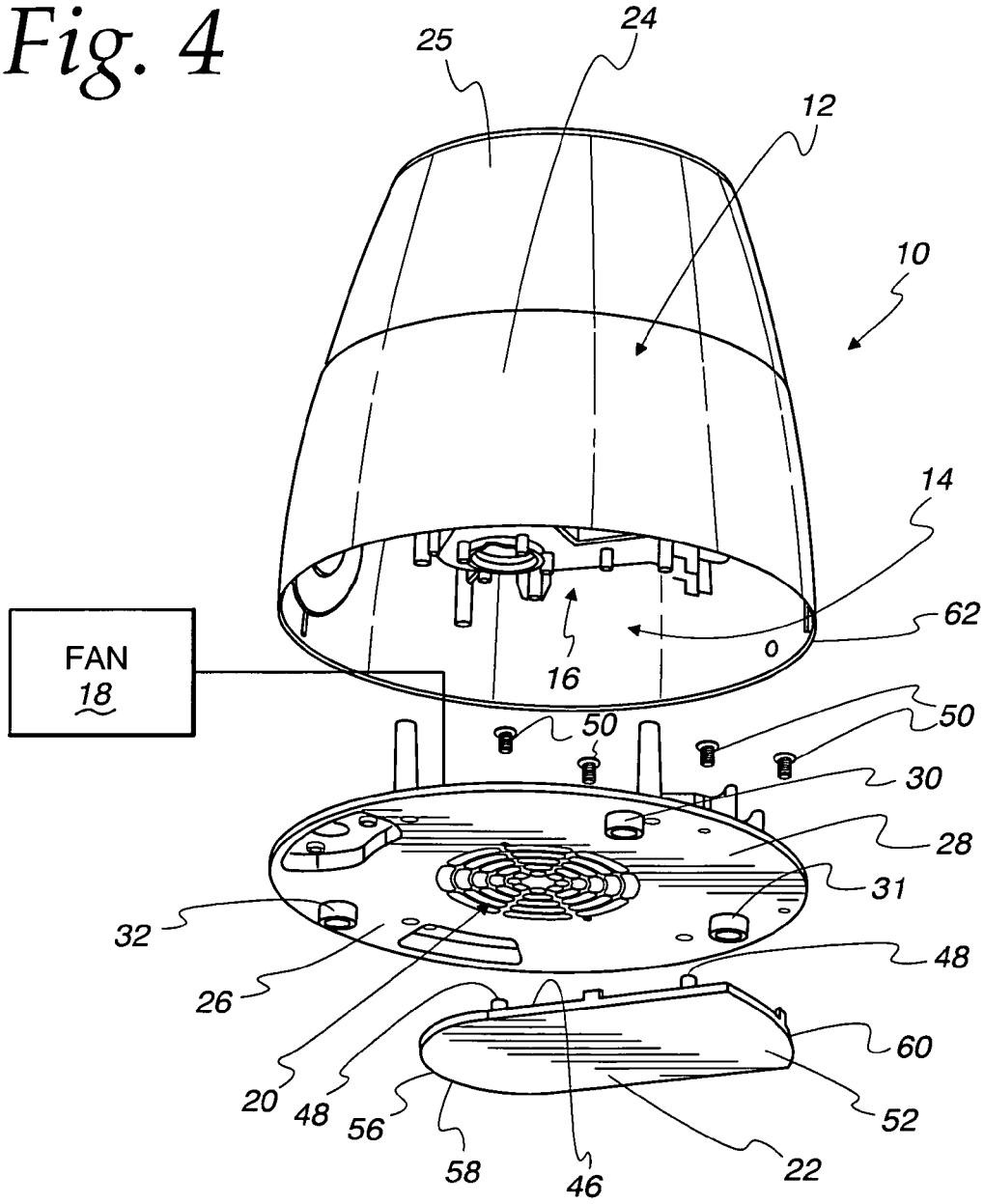
FIG. 4 is an exploded, bottom, perspective view of the appliance in FIGS. 2 and 3.
Figure 5:
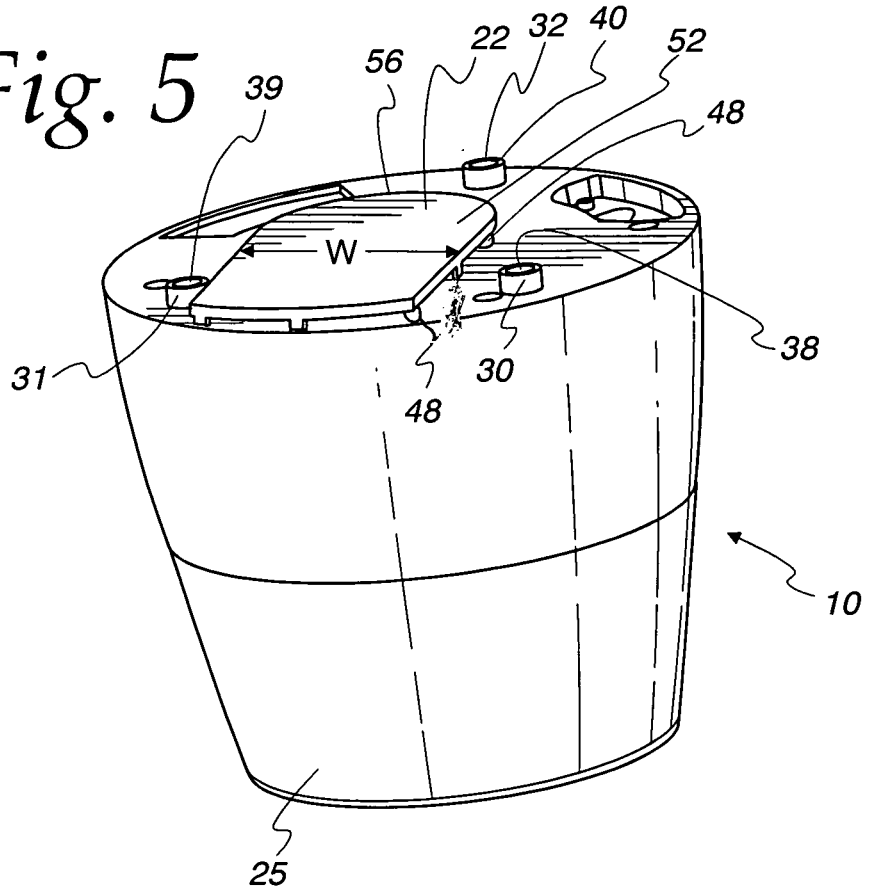
FIG. 5 is a bottom, perspective view of the appliance in an assembled state.
Figure 6:
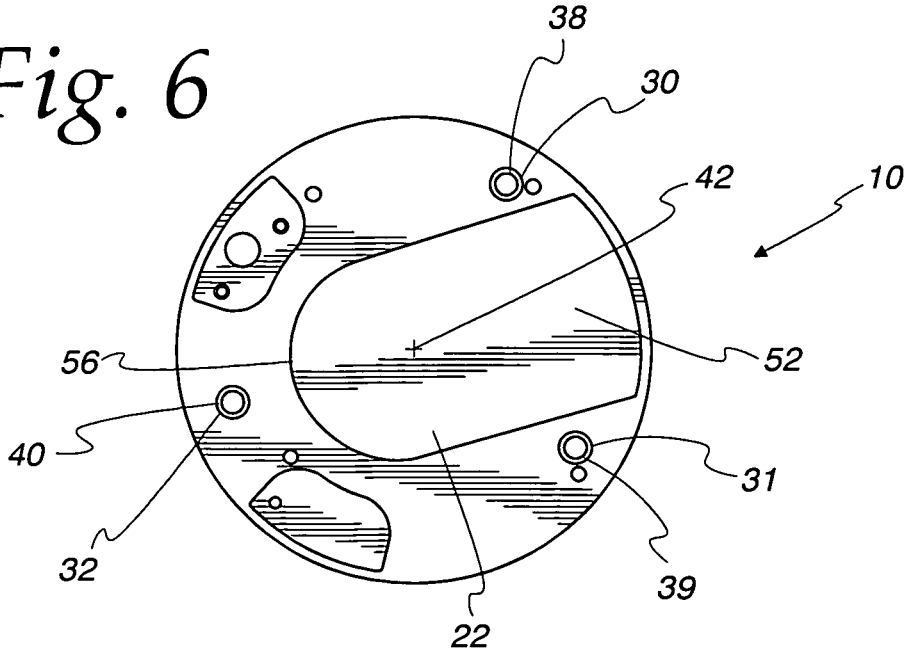
FIG. 6 is a bottom view of the assembled appliance in FIGS. 2-5.

In FIG. 1, a portable appliance, according to the present invention, is shown at 10. The portable appliance 10 is shown schematically in FIG. 1 to encompass virtually an unlimited number of different constructions that perform potentially different functions, such as introducing humidified or purified air into a surrounding space. Generally, the portable appliance 10 is one having a housing 12 defining a space 14 for at least one operating component 16. One or more of the operating components 16 define an air moving mechanism 18 for causing atmospheric air to be drawn into the housing space 14 through an inlet opening 20 to at least one of: a) cool at least one of the operating components 16; b) be treated by at least one of the operating components 16; and c) cause movement of a fluid within the housing space 14. The housing 12 further has a spacing wall 22 that underlies the inlet opening 20 and bounds an intake space through which atmospheric air is guided in a generally horizontal path towards the inlet opening 20.

While, as noted above, the inventive concept can be used on portable appliances 10 having very different configurations and functions, the invention will now be described with one exemplary type of portable appliance, in the form of a humidifier, of the type shown in U.S. Pat. No. 7,441,756, the disclosure of which is incorporated herein by reference. Such humidifiers intake air to move generated steam within and from an internal space to the surrounding environment. Since the operation of the humidifier is disclosed in detail in U.S. Pat. No. 7,441,756, the description herein will focus on only those components critical to understanding the details of the present invention.

Referring now to FIGS. 2-6, the appliance 10 is shown with the housing 12 having a tapering cylindrical shape extending around the space 14. The operating components 16, as described in U.S. Pat. No. 7,441,756, reside within the space 14 and make up an air moving mechanism 18, as in the form of a fan.

The housing 12 is made up of a peripheral wall 24 and a first/bottom wall 26 that cooperatively bound the space 14. A separable container 25 is configured to store a supply of fluid, such as water. The bottom wall 26 has a downwardly facing surface 28 upon which spacing elements 30, 31, 32 are provided to cooperatively support the portable appliance 10 stably in an operative position upon an upwardly facing, subjacent support surface 36. More specifically, the spacing elements 30, 32 have bearing surfaces 38, 39, 40 that are each spaced from the downwardly facing surface 28 a distance D.

The inlet opening 20 is preferably located at or adjacent the horizontal center 42 of the bottom wall 26. In this embodiment, the inlet opening 20 is defined by a circular grill arrangement that is concentric with the horizontal center 42. It should be understood that reference to the inlet opening 20, in the singular, is also intended to encompass an opening that is defined by a plurality of discrete openings, as shown in the drawn figures.

The spacing wall 22, as previously noted, underlies the inlet opening 20 and bounds, in conjunction with the bottom wall 26, an intake space 44 through which atmospheric air is guided in a generally horizontal path towards the inlet opening 20.

In this embodiment, the downwardly facing surface 28 on the bottom wall 26 is substantially flat/planar. The spacing wall 22 has a substantially flat, upwardly facing surface 46 that faces, and is spaced beneath, the downwardly facing surface 28 on the bottom wall 26. In the depicted embodiment, the upwardly and downwardly facing surfaces 46, 28, respectively, are substantially parallel to each other so that the intake space 44 has a substantially uniform vertical depth where the spacing wall 22 underlies the bottom wall 26.

To maintain the uniform spacing between the walls 22, 26, a plurality of spacer elements 48 reside between the walls 22, 26. In this embodiment, the spacer elements 48 are formed as one piece with the spacing wall 22. Threaded fasteners 50 extend through the bottom wall 26 and spacer elements 48 into the spacing wall 22 to maintain the spacing wall 22 in place. With this arrangement, the intake space has a vertical height D1.

The vertical dimensions of the spacer elements 48 and thickness of the spacing wall 22 are selected so that the downwardly facing surface 52 on the spacing wall 22 projects from the bottom wall 26 a distance D2 that is less than the distance D, representing the projection of the bearing surfaces 38, 39, 40 from the bottom wall 26. Accordingly, with the appliance 10 supported on a surface 36 that is substantially rigid, there is a slight gap at 54 between the subjacent support surface 36 and the downwardly facing surface 52 on the spacing wall 22.

In the event that the appliance 10 is placed on a compressible support surface 36, the bearing surfaces 38, 39, 40 may depress the support surface 36, thereby bringing the downwardly facing surface 52 into engagement with the compressed support surface 36. The spacing wall 22 is configured to cause continuous air delivery through the intake space 44 in spite of this condition.

More particularly, the spacing wall 22 has a generally rectangular shape with a peripheral edge 56 with a portion 58 that is curved to be at least nominally conformed to the circular shape of the inlet opening 20.

The spacing wall 22 extends radially outwardly from the center 42 to a peripheral edge portion 60 that is substantially flush with, and at least nominally conforms to, the peripheral edge 62 of the housing 12, adjacent to the bottom wall 26.

The spacing wall 22 is shown with an area that is substantially less than the area of the downwardly facing surface 28 on the bottom wall 26. With the depicted arrangement, the intake space 44 is defined substantially fully around a peripheral edge of the spacing wall 22. The spacing wall 22 is aligned to substantially fully block the inlet opening 20, as viewed from the bottom of the appliance 10. The edge portion 60 extends through less than 90° around the peripheral edge 62 of a housing 12. The width W of the spacing wall 22 is roughly equal to the diameter of the inlet opening 20, shown as a circular shape.

With this arrangement and with the appliance 10 on a hard support surface 36, atmospheric air can be drawn substantially directly into the air inlet 20 with only a short diversionary path from horizontal to vertical thereat. In the event that the bottom of the portable appliance 10 is pressed into a softer support surface 36, the spacing wall 22 permits continued high volume in-flow of air adequate to operate the appliance 10. The area of the downwardly facing surface 52 of the spacing wall 22 is adequate to disperse weight forces to over an area that minimizes the depression of the appliance 10 into a soft support surface 36. At the same time, the downwardly facing surface 52 reconfigures the support surface 36 so that the intake space 44 is maintained substantially fully around the periphery of the spacing wall 22. In a worse case, the intake space 44 will be maintained at least at the peripheral edge 62 of the housing 12. A radial path, with respect to the vertical central axis CA of the apparatus, is maintained from that location to the inlet opening 20.

The wall 22 could extend fully around the periphery of the housing 12, but for reasons stated above, this form is not preferred.

Many variations of the inventive structure are contemplated within the schematic showing of FIG. 1. For example, the air moving mechanism 18 may be something that is active, such as a fan with a movable blade assembly, or something that induces air movement through passive means, such as convection caused by temperature difference, etc.

The schematic showing in FIG. 1 is further intended to encompass a construction wherein the intake space 44 is defined entirely by a separate component, rather than by formation in conjunction with the bottom wall 26.

The size, shape, thickness, location, etc. for the spacing wall 22 can vary over wide ranges. Further, the precise relationship between the spacing wall 22 and bottom wall 28 likewise may vary significantly from what is shown in the preferred form.

The bearing surfaces 38, 39, 40 might be made substantially flush with the surface 62 on the spacing wall 22 so that these surfaces simultaneously engage the support surface 36 for the appliance.

The schematic showing of the appliance 10, as noted above, is not limited to any specific form. In the appliance shown in FIGS. 2-6, the operating components produce vaporized air/steam, as shown in U.S. Pat. No. 7,441,756, with the air moving mechanism shown as a fan, causing air to be drawn into the housing space 14 to force movement of the generated steam to the surrounding space.

As an alternative design, the operating components could define filtering elements through which air is forced and/or an ultraviolet light that treats air that moves through the appliance 10.

As a further alternative, the appliance may have operating components that generate heat in operation, regardless of the nature thereof. The air moving mechanism causes air to be drawn into the housing space to cool at least one such operating component that generates heat.

The foregoing disclosure of specific embodiments is intended to be illustrative of the broad concepts comprehended by the invention.

The invention claimed is:

1. A portable appliance comprising:

a housing defining a space; and operating components in the space, the housing having a top and bottom, the operating components comprising an air moving mechanism for causing atmospheric air to be drawn into the housing space to at least one of: a) cool at least one of the operating components; b) be treated by at least one of the operating components; and c) cause movement of a fluid within the housing space, the housing having a first wall with a downwardly facing surface in which an inlet opening is defined through which atmospheric air is drawn into the housing space, the housing further comprising a spacing wall that underlies the inlet opening and bounds in conjunction with the first wall an intake space through which atmospheric air is guided in a generally horizontal path towards the inlet opening, the portable appliance configured to be supported stably in an operative position upon an upwardly facing, subjacent support surface so that the upwardly facing, subjacent support surface underlies the inlet opening.

2. The portable appliance according to claim 1 wherein the downwardly facing surface is substantially flat and the spacing wall has a substantially flat surface that faces, and is spaced beneath, the downwardly facing surface on the first wall.

3. The portable appliance according to claim 2 wherein the downwardly facing surface on the first wall and the flat surface on the spacing wall are substantially parallel to each other.

4. The portable appliance according to claim 2 wherein the spacing wall has a peripheral edge and the intake space is defined substantially fully around the peripheral edge of the spacing wall.

5. The portable appliance according to claim 1 wherein the spacing wall is aligned to substantially fully block the inlet opening as viewed from the bottom of the housing.

6. The portable appliance according to claim 1 wherein the housing has a peripheral edge and the intake space is defined at and around at least a portion of the peripheral edge of the housing.

7. The portable appliance according to claim 1 wherein the first wall has a horizontal center and the inlet opening is located at or adjacent to the horizontal center.

8. The portable appliance according to claim 1 wherein there is a plurality of spacer elements that reside between the first wall and the spacing wall.

9. The portable appliance according to claim 1 wherein the inlet opening has a generally circular shape and the spacing wall has a portion that is curved and at least nominally conformed to the circular shape of the inlet opening.

10. The portable appliance according to claim 1 wherein the operating components produce steam and the air moving mechanism causes air to be drawn into the housing space to force movement of the steam within the housing space.

11. The portable appliance according to claim 1 wherein the operating components treat air and the air moving mechanism causes air to be drawn into the housing space to be treated by the operating components.

12. The portable appliance according to claim 1 wherein at least one of the operating components generates heat in operation and the air moving mechanism causes air to be drawn into the housing space to cool the at least one operating component that generates heat.

13. The portable appliance according to claim 1 wherein the portable appliance further comprises spacing elements on the downwardly facing surface of the first wall defining bearing surfaces that cooperatively support the portable appliance in the operative position upon an upwardly facing, subjacent support surface.

14. The portable appliance according to claim 13 wherein the bearing surfaces project further downwardly from the downwardly facing surface on the first wall than the spacing wall.

15. The portable appliance according to claim 1 wherein the spacing wall has an area that is substantially less than an area of the downwardly facing surface on the first wall.

16. The portable appliance according to claim 6 wherein the intake space is defined through less than 90° around the peripheral edge of the housing.

17. The portable appliance according to claim 8 wherein the portable appliance further comprises at least one fastener that extends through the first wall and one of the spacer elements into the spacing wall to maintain the spacing wall in place.

18. A portable appliance comprising:

a housing defining a space;

the housing having a top and bottom; and operating components making up an air moving mechanism for causing atmospheric air to be drawn into the housing space to at least one of: a) cool at least one of the operating components; b) be treated by at least one of the operating components; and c) cause movement of a fluid within the housing space, wherein the housing has an inlet opening through which atmospheric air is drawn vertically upwardly into the housing space, the housing further comprising a spacing wall that underlies the inlet opening to at least partially block the inlet opening as viewed from the bottom of the housing and bound an intake space through which atmospheric air is guided in a generally horizontal path towards the inlet opening.

19. The portable appliance according to claim 18 wherein the spacing wall has a peripheral edge and the intake space is defined substantially fully around the peripheral edge of the spacing wall.

20. The portable appliance according to claim 18 wherein the housing has a peripheral edge and the intake space is defined at and around at least a portion of the peripheral edge of the housing.

21. A portable appliance comprising:

a housing defining a space; and operating components in the space, the housing having a top and bottom, the operating components comprising an air moving mechanism for causing atmospheric air to be drawn into the housing space to at least one of: a) cool at least one of the operating components; b) be treated by at least one of the operating components; and c) cause movement of a fluid within the housing space, the housing having a first wall with a downwardly facing surface in which an inlet opening is defined through which atmospheric air is drawn into the housing space, the housing further comprising a spacing wall that underlies the inlet opening and bounds in conjunction with the first wall an intake space through which atmospheric air is guided in a generally horizontal path towards the inlet opening, wherein the portable appliance further comprises spacing elements on the downwardly facing surface of the first wall defining bearing surfaces that cooperatively support the portable appliance on an upwardly facing, subjacent support surface, wherein the bearing surfaces project further downwardly from the downwardly facing surface on the first wall than the spacing wall.

* * * * *